US005091504A

United States Patent [19]

Blaeser et al.

[11] Patent Number: 5,091,504

[45] Date of Patent: Feb. 25, 1992

[54] ENHANCED POLYESTER COPOLYMER FIBER

[75] Inventors: Eric J. Blaeser; Carl S. Nichols, both of Charlotte, N.C.

[73] Assignee: Hoechst Celanese Corporation, Somerville, N.J.

[21] Appl. No.: 555,883

[22] Filed: Jul. 20, 1990

Related U.S. Application Data

[62] Division of Ser. No. 282,076, Dec. 9, 1988, Pat. No. 4,975,233.

[51] Int. Cl.[5] ..... C08G 63/20

[52] U.S. Cl. ..... 528/272; 528/300; 528/308.2; 528/308.6; 528/502; 528/503; 525/437; 525/449; 264/210.6

[58] Field of Search ..... 528/272, 300, 308.2, 528/308.6, 502, 503; 525/437, 449; 264/210.6

[56] References Cited

U.S. PATENT DOCUMENTS

| | | | |
|---|---|---|---|
| 3,668,187 | 6/1972 | King et al. | 528/296 |
| 3,671,495 | 6/1972 | King et al. | 528/274 |
| 4,049,621 | 9/1977 | Gilkey et al. | 524/90 |
| 4,211,678 | 7/1980 | Henry et al. | 524/605 |
| 4,377,682 | 3/1983 | Ohguchi et al. | 528/301 |
| 4,526,738 | 7/1985 | Miyoshi et al. | 264/176 |
| 4,668,764 | 5/1987 | Satou | 528/308.1 |
| 4,704,329 | 11/1987 | Hancock et al. | 428/369 |
| 4,745,142 | 5/1988 | Ohwaki et al. | 524/87 |

*Primary Examiner*—John Kight, III
*Assistant Examiner*—S. A. Acquah
*Attorney, Agent, or Firm*—Gregory N. Clements

[57] ABSTRACT

The invention is a method of producing a polyester filament which has a superior combination of tensile, dyeability and shrinkage properties. The method comprises forming a polyester-polyethylene glycol copolymer from a mixture consisting essentially of a terephthalic acid or dimethyl terephthalate, ethylene glycol, and polyethylene glycol, with the polyethylene glycol having an average molecular weight of between about 200 and 1500 grams per mole and being added in an amount sufficient to produce a polyester-polyethylene glycol copolymer in which the polyethylene glycol is present in an amount of between about 1.0 and 4 percent by weight of the copolymer formed; forming filament from the copolymer drawing the copolymer filament; and heat setting the drawn filament. The invention also comprises the enhanced fiber formed by the process.

22 Claims, 1 Drawing Sheet

LIGHTFASTNES OF PET/PEG COPOLYMERS
AT VARIOUS PEG WEIGHT PERCENTS
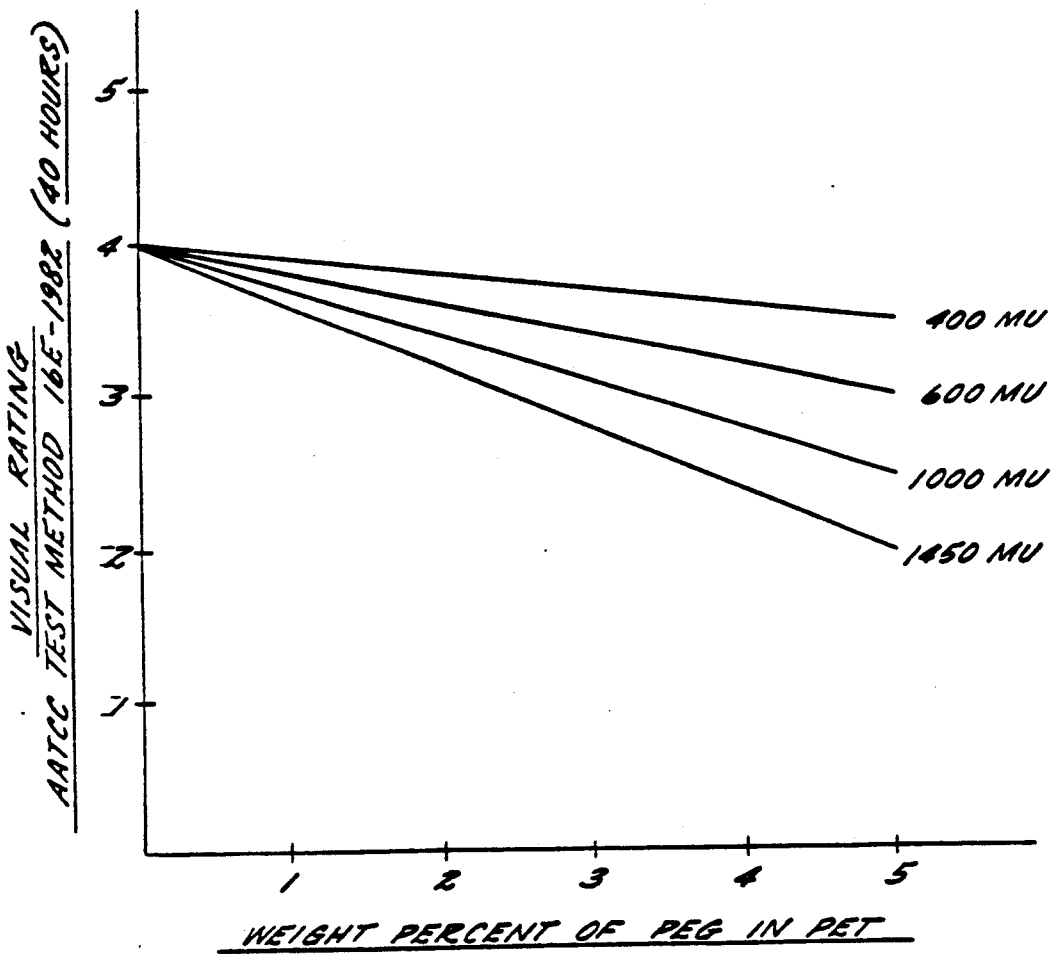

ENHANCED POLYESTER COPOLYMER FIBER

This is a division of application Ser. No. 07/282,076, filed Dec. 9, 1988, now U.S. Pat. No. 4,975,233.

FIELD OF THE INVENTION

The present invention relates to the manufacture of polyester fibers for textile applications, and in particular relates to an enhanced polyester copolymer fiber material which demonstrates improved tensile properties and improved dyeability.

BACKGROUND OF THE INVENTION

Polyester has long been recognized as a desirable material for textile applications The basic processes for the manufacture of polyester are relatively well known and straightforward, and fibers from polyester can be appropriately woven or knitted to form textile fabric. Polyester fibers can be blended with other fibers such as wool or cotton to produce fabrics which have the enhanced strength, durability and memory aspects of polyester, while retaining many of the desired qualities of the natural fiber with which the polyester is blended.

As with any fiber, the particular polyester fiber from which any given fabric is formed must have properties suitable for manufacture, finishing, and end use of that fabric. Typical applications include both ring and open-end spinning, either with or without a blended natural fiber, weaving or knitting, dyeing, and finishing. In addition, it has long been known that synthetic fibers such as polyester which are initially formed as extruded linear filaments, will exhibit more of the properties of natural fibers such as wool or cotton if they are treated in some manner which changes the linear filament into some other shape. Such treatments are referred to generally as texturizing, and can include false twisting, crimping, and certain chemical treatments.

In a homopolymeric state, polyester exhibits good strength characteristics. Typical measured characteristics include tenacity, which is generally expressed as the grams per denier required to break a filament, and the modulus, which refers to the filament strength at a specified elongation ("SASE"). Tenacity and modulus are also referred to together as the tensile characteristics or "tensiles" of a given fiber In relatively pure homopolymeric polyester, the tenacity will generally range from about 3.5 to about 8 grams per denier, but the majority of polyester has a tenacity of 6 or more grams per denier. Only about 5 percent of polyester is made with a tenacity of 4.0 or less.

In many applications, of course, it is desirable that the textile fabric be available in a variety of colors, accomplished by a dyeing step. Substantially pure polyester, however, is not as dyeable as most natural fibers, or as would otherwise be desired, and therefore must usually be dyed under conditions of high temperature, high pressure, or both, or at atmospheric conditions with or without the use of swelling agents commonly referred to as "carriers". Accordingly, various techniques have been developed for enhancing the dyeability of polyester.

One technique for enhancing the dyeability of polyester is the addition of various functional groups to the polymer to which dye molecules or particles such as pigments themselves attach more readily, either chemically or physically, depending upon the type of dyeing technique employed. Common types of additives include molecules with functional groups that tend to be more receptive to chemical reaction with dye molecules than is polyester. These often include carboxylic acids (particularly dicarboxylic or other multifunctional acids), and organo metallic sulfate or sulfonate compounds.

Another additive that has been proposed is polyethylene glycol ("PEG"), which has been shown to offer advantages when incorporated with polyester into textile fibers, including antistatic properties and improved dyeing characteristics. If other practical factors and necessities are ignored, adding increased amounts of PEG to polyester will increase the dyeability of the resulting polymer. Nevertheless, there are a number of disadvantages associated with the application of polyethylene glycol to polyester using these prior techniques, particularly when the PEG is added in amounts of 5 to 6 percent or more by weight, amounts which the prior references indicate are necessary to obtain the desired enhanced dyeability. These disadvantages are not generally admitted in the prior art patents and literature, but are demonstrated to exist by the lack of known commercial textile processes which use fibers formed essentially solely from copolymers of polyester and polyethylene glycol. These shortcomings can be demonstrated, however, by those of ordinary skill in the art using appropriate evaluation of the prior technology.

Most notably, commercially available fibers formed from polyester-polyethylene glycol copolymers tend to exhibit improved dyeability at the expense of tensiles; improved dyeability at the expense of shrinkage; improved tensiles at the expense of shrinkage; poor light fastness; poor polymer color (whiteness and blueness); unfavorable process economies; and poor thermal stability.

In some earlier techniques, in addition to the negative characteristics introduced into polyester fiber by the addition of polyethylene glycol, it has been believed that where amounts smaller than 5 to 6 percent of polyethylene glycol are used, they must be used in conjunction with some other molecule or functional group which would concurrently enhance the dyeability of the fiber. For example, U.S. Pat. No. 4,049,621 issued to Gilkey et al states that polyester fibers enhanced with less than 6 weight percent polyethylene glycol do not exhibit acceptable dyeability without a carrier. None of the prior techniques teach or suggest that modification of polyester fiber with polyethylene glycol alone in amounts lower than about 5 percent can have any significant beneficial effect on the various desirable characteristics of a polyester fiber.

Occasionally polyethylene glycol has been used in the manufacture of polyester fiber in conjunction with other additives to compensate for the disadvantages introduced by those other additives. For example, in U.S. Pat. No. 4,526,738 issued to Miyoshi et al, a metal sulfoisophthalic group is added to permit the dyeability of polyester fiber with cationic or basic dyes. This functional group, however, suppresses the melting point, lowers the tenacity, and increases the melt viscosity of the resulting polyester and fiber formed therefrom In order to compensate for these disadvantages, polyethylene glycol is added to moderate both the suppression of the melting point and the increase in melt viscosity of the polyester while still encouraging increased dyeability. As noted by Miyoshi, however, the resulting polymer must be maintained under rather specific conditions of degree of polymerization.

Accordingly, there exists no commercially viable method for using polyethylene glycol alone to enhance the dyeing properties of polyester fiber without sacrificing desirable characteristics of strength, shrinkage, light fastness, thermal stability and color.

OBJECT AND SUMMARY OF THE INVENTION

It is therefore an object of the present invention to provide a method of producing a polyester fiber which has a superior combination of tensile, dyeability and shrinkage properties. The method comprises forming a polyester-polyethylene glycol copolymer from a mixture consisting essentially of terephthalic acid or dimethylterephthalate, ethylene glycol, and polyethylene glycol. The polyethylene glycol has an average molecular weight of about 200 to 1500 grams per mole and is added in an amount sufficient to produce a polyester-polyethylene glycol copolymer in which the polyethylene glycol is present in an amount of about 1.0 to 4 percent by weight of the copolymer formed. The copolymer is drawn into filament at a draw ratio sufficient to produce the desired enhanced tensile properties in the filament, after which the drawn filament is heated at a temperature sufficiently high enough to set the desired enhanced tensile properties in the copolymer filament and to maintain the shrinkage of the copolymer filament substantially the same as the shrinkage of the nonenhanced polymer filament, but without lowering the dyeability of the resulting fiber below the dyeability of the nonenhanced fiber.

Because of the relationship between tensile strength and dyeability, the invention also provides a method of enhancing the dyeability of polyester fiber while maintaining the tensiles of that fiber substantially equivalent to its tensile strength when nonenhanced. In a similar manner, the invention provides a method of concurrently enhancing both dyeability and tensile strength compared to a nonenhanced polyester fiber.

The foregoing and other objects, advantages and features of the invention, and the manner in which the same are accomplished, will become more readily apparent upon consideration of the following detailed description of the invention taken in conjunction with the accompanying drawing, which illustrates preferred and exemplary embodiments.

DESCRIPTION OF THE DRAWINGS

The FIGURE is a plot of the lightfastness of various fibers formed according to the present invention, plotted against the weight percent of the added polyethylene glycol.

DETAILED DESCRIPTION OF THE PREFERRED EMBODIMENT

The invention comprises forming a polyester-polyethylene glycol copolymer from a mixture consisting essentially of terephthalic acid or dimethyl terephthalate, ethylene glycol, and polyethylene glycol, with the polyethylene glycol having an average molecular weight determined by chromatography of between about 200 and 1500 grams per mole and being added in an amount sufficient to produce a polyester-polyethylene glycol copolymer in which the polyethylene glycol is present in an amount of between about 1.0 and 4 percent by weight of the copolymer formed. In a preferred embodiment, the polyethylene glycol has an average molecular weight of about 400 grams per mole and is added in an amount sufficient to produce a copolymer having about 2 percent by weight polyethylene glycol.

As is known to those familiar with the commercial production of polyester, the polyester polymer can be formed from a starting mixture of terephthalic acid and ethylene glycol, or from dimethyl terephthalate and ethylene glycol. The polyester may be manufactured using a batch process or a continuous process. The reaction proceeds through the well known steps of esterification and condensation to form polyethylene terephthalate; commonly referred to as polyester or PET. A number of catalysts or other additives have been found to be useful in promoting either the esterification or condensation reactions, or in adding certain properties to the polyester. For example, antimony compounds are commonly used to catalyze the condensation reaction and inorganic compounds such as titanium dioxide ($TiO_2$) are commonly added as delusterants, or for other similar purposes.

The polyester is formed as a viscous liquid which is forced through a spinnerette head to form individual filaments; a process referred to as "spinning". The spun filaments are subsequently drawn, heat-set, crimped, dried and cut with the appropriate lubricating finishes added in a conventional manner. It will be understood by those familiar with textile manufacturing in general and synthetic fiber manufacture in particular that the word "spinning" has two connotations in the art, the first being a term used to describe the manufacture of fiber from a polymer melt, and the other being the twisting of fibers together—natural, synthetic, or blended—to form spun yarn. Both terms will be used herein in their conventional sense.

The polyester-polyethylene glycol copolymer of the present invention is produced by the previously described production methods for polyester, i.e., esterification followed by polymerization via condensation. A batch process or a continuous process may be employed, and catalysts and/or other typical additives may be employed. It will be understood that the presence or absence of such other materials does not affect the essential techniques or results of the present invention, although they may modify or enhance the polyester-polyethylene glycol copolymer in the same desirable manner as for polyester itself.

A batch process of the present invention, for example, starts with esterification performed at atmospheric pressure and at 180°-220° C. The reactor will be loaded With dimethyl terephthalate (3700 lbs); ethylene glycol (2400 lbs); a catalyst (2.0 lbs); and diethylene glycol (7.0 lbs) as is conventionally carried out in a customary batch polyester process. After esterification is complete, the polyethylene glycol (100 lbs) having an average molecular weight of 600 as determined by chromatography is added to the reactor. Other additives such as delusterants, thermal stabilizers, optical brighteners and/or bluing agents, etc., may be added at this initial polymerization stage. The polymerization stage is run at 280°-300° C. at a strong vacuum of 0.3-3.0 mm Hg pressure.

Alternatively, the above batch process may be run in a manner such that the polyethylene glycol is loaded with the other raw materials at the beginning of the esterification process. Furthermore, it is contemplated for a batch operation that some of the polyethylene glycol may alternatively be added with the raw materials at the beginning of the esterification process, while the remainder of the polyethylene glycol is added at the beginning of the polymerization stage.

A continuous process of the present invention starts with a flow of raw materials, including terephthalic acid (TA) and ethylene glycol (EG) in a ratio of EG/TA of 1.1–1.4 mole ratio. The polyethylene glycol may be added with the TA and EG, or it may be added downstream of the raw material inlet. Like the batch process, other additives and/or catalysts may be fed into the reactor with TA and EG, as is customary with continuous operations for polyester above.

In the primary esterification stage of the continuous process, the reactor is run at a pressure of 20–50 psi and a temperature of 240°–260° C. In the conventional secondary esterification stage of the continuous process, the reactor is run at atmospheric pressure and at a temperature of 260°–280° C. At the low polymerization stage, the reactor is run at a pressure of 15–50 mm Hg and at a temperature of 265°–285° C. At the final polymerization stage, the continuous reactor is operated at a pressure of 0.3 to 3.0 mm Hg and at a temperature of 275°–305° C.

The heat-setting temperatures employed in a drawing process are raised high enough to set the desired tensile properties in the copolymer filament and to maintain the shrinkage of the copolymer filament substantially the same as the shrinkage of the nonenhanced polyester filament In this regard, heat-setting temperatures most preferred are generally greater than 150° C. and preferably between about 180° and 220° C. In conventional processes, heat setting temperatures greater than about 150° C. cause the dyeability of the fiber to decrease below acceptable levels for a product which is desirably atmospherically dyeable. The enhancement of the fiber provided by the present invention is, of course, also exhibited when the fiber is dyed under pressurized conditions.

As set forth herein, the temperatures expressed for heat setting (e.g. Tables 2 and 6 herein) have been measured from the middle of a heat set roll and then corrected for shell loss to give a reasonable approximation of the contact temperature of the shell of the heat roll with which the fiber is in contact. All temperatures are expressed in degrees centigrade.

It is known that an increase in polyethylene glycol (PEG) in PEG/PE (PE=polyester) copolymers will increase the dyeability. However, an increase in PEG adversely decreases the physical properties (tensile strengths) and decreases the thermal stability. The use of the present invention boosts the physical properties, specifically the tensiles of fiber relative to a control fiber at the equivalent dyeability. These higher fiber tensiles have been demonstrated to translate into improved textile yarn strengths in 50/50 poly/cotton yarns of approximately 8 percent. Alternatively, and depending upon the application desired for the resulting fiber, yarn or fabric, the present invention can be used to boost the dyeability of a given fiber while maintaining tensiles substantially equivalent to an unmodified or control fiber. Thus, the present invention provides a unique balance of physical properties and yet yields excellent dyeability of the polyester-polyethylene glycol copolymer compared with polyester itself.

Table 1 shows general standard spinning conditions including normal quenching under which the PEG/PE filament of the present invention was produced.

TABLE 1

| Spinning Conditions | |
|---|---|
| Hole Diameter, Inches | 0.01 |
| Spinning Temperature | 260–300° C. |
| Wind-Up Speed, FPM | 3800 |
| Throughput per hole | 0.36 g./min. |

Tables 2 and 3 illustrate a number of characteristics of the fiber formed according to the present invention, and using terephthalic acid and ethylene glycol as the starting materials, and sufficient polyethylene glycol to produce a copolymer having 2 percent by weight polyethylene glycol. The polyethylene glycol had an average molecular weight determined by chromatography of approximately 400 grams per mole. The control was a 1.0 DPF (denier per filament) polyester homopolymer formed under otherwise identical conditions. All of the 8 samples and the control were ring-spun into a 100 percent synthetic 28/1 yarn and into a 50/50 poly/cotton (i.e. polyester-cotton blend) 28/1 yarn. The same fibers were also spun using open-end spinning at a rotor speed 95,000 rpm into a 50/50 poly/cotton 30/1 yarn. The dyeing conditions set forth were pressure dyeing (A), atmospheric dyeing with no carrier (B), and atmospheric dyeing with carrier (C), for 100 percent synthetic ring spun yarn knitted into hoselegs In Table 3 and all other dyeability descriptions set forth herein, the dyeability of the samples is measured against the dyeability (calibrated as 100.0) of 1.0 dpf unenhanced polyester fiber and yarns and fabrics formed therefrom. The particular dyeing parameters are set forth in Table 4.

TABLE 2

| Sample | Draw Ratio | TEMP (°C.) | DPF | TENACITY ↑ | MODULUS | ELONGATION | HAS |
|---|---|---|---|---|---|---|---|
| 1 | 3.218 | 186.9 | 0.97 | 5.26 | 3.49 | 24.2 | 7.32 |
| 2 | 3.422 | 186.9 | 0.91 | 5.35 | 3.75 | 21.2 | 7.66 |
| 3 | 3.349 | 186.9 | 0.93 | 6.14 | 4.09 | 25.8 | 8.06 |
| 4 | 3.349 | 181.3 | 0.93 | 5.57 | 3.97 | 18.8 | 8.06 |
| 5 | 3.349 | 192.0 | 0.93 | 5.99 | 4.01 | 21.1 | 7.55 |
| 6 | 3.349 | 186.9 | 0.93 | M | M | M | 7.43 |
| 7 | 3.349 | 192.0 | 0.93 | 6.04 | 4.27 | 23.0 | 7.44 |
| 8 | 3.265 | 192.0 | 0.96 | 5.69 | 4.03 | 24.4 | M |
| C | 3.144 | 166.3 | 0.98 | 5.40 | 3.40 | 30.0 | 7.00 |

↑ Average Tenacity of a fully drawn, crimped and dried tow.
M = Lack of formal data
C = Control (unenhanced polyester)

As used in Table 2, tenacity is the breaking load expressed as grams per denier, the modulus is the strength at ten percent elongation expressed in grams per denier; the elongation is the percentage increase in length the filament can undergo before breaking, and the hot air shrinkage (HAS) is the percent decrease in length of the filament when exposed to air at 400° Fahrenheit; tenacity, modulus, and elongation being determined in accordance with ASTM D-3822 for tensile properties.

TABLE 3

| | 50/50 OES Yarn (Poly/Cotton) | | | 100% RING SPUN YARN (Poly) | | |
|---|---|---|---|---|---|---|
| Sample | SKEIN BREAK FACTOR | SINGLE END TENACITY | (400° F.) HAS | SKEIN BREAK FACTOR | SINGLE END TENACITY | HAS |
| 1 | 1910 | 1.46 | 7.2 | 4747 | 3.26 | 8.5 |
| 2 | 1950 | 1.49 | 7.3 | 4704 | 3.55 | 8.0 |
| 3 | 1978 | 1.49 | 7.0 | 4881 | 3.47 | 8.5 |
| 4 | 1966 | 1.48 | 8.2 | 4521 | 3.35 | 8.8 |
| 5 | 2004 | 1.43 | 7.4 | 4717 | 3.49 | 7.7 |

TABLE 3-continued

| | | | | | | |
|---|---|---|---|---|---|---|
| 6 | 1963 | 1.51 | 7.5 | 4641 | 3.40 | 9.0 |
| 7 | 1955 | 1.43 | 7.4 | 4738 | 3.43 | 8.0 |
| 8 | M | M | M | 4731 | 3.34 | 9.0 |
| C | 1820 | 1.36 | 7.3 | 4659 | 3.15 | 8.5 |

| | 50/50 RING SPUN (Poly/Cotton) | | | 100% RING SPUN (POLY) HOSELEGS (DYEABILITY) | | |
|---|---|---|---|---|---|---|
| Sample | SKEIN BREAK FACTOR | SINGLE END TENACITY | HAS | A§ | B§ | C§ |
| 1 | 2883 | 2.03 | 7.6 | 107.7 | 127.3 | 105.4 |
| 2 | 3079 | 2.31 | 7.2 | 102.5 | 112.5 | 96.2 |
| 3 | 2909 | 2.08 | 7.5 | 103.6 | 117.9 | 100.1 |
| 4 | 2969 | 2.11 | 7.8 | 104.1 | 121.9 | 105.6 |
| 5 | 2973 | 2.15 | 7.1 | 100.4 | 118.6 | 97.9 |
| 6 | 2885 | 2.18 | 9.0 | 103.2 | 124.5 | 103.5 |
| 7 | 2919 | 2.18 | 8.8 | 100.0 | 114.4 | 97.2 |
| 8 | 2767 | 1.97 | 7.5 | 108.1 | 128.3 | 107.3 |
| C | 2708 | 1.99 | 9.0 | 100.0 | 100.0 | 100.0 |

| | K/S values | | |
|---|---|---|---|
| | A§ | B§ | C§ |
| 1 | 19.62 | 6.18 | 7.62 |
| 2 | 18.67 | 5.46 | 6.95 |
| 3 | 18.88 | 5.73 | 7.23 |
| 4 | 18.96 | 5.92 | 7.63 |
| 5 | 18.29 | 5.76 | 7.07 |
| 6 | 18.80 | 6.05 | 7.48 |
| 7 | 18.22 | 5.55 | 7.02 |
| 8 | 19.70 | 6.23 | 7.75 |
| C | 18.22 | 4.86 | 7.22 |

HAS = Hot Air Shrinkage
(§-Table 4 Techniques)

For comparison purposes, the data for dyeability set forth in Table 3 has been initially presented as a percentage, with 100.0 representing the control fiber described herein, and the values greater than 100.0 representing Samples 1 through 8, and demonstrating the enhanced dyeability resulting from the invention. In an absolute sense, the dyeability data is set forth as a set of K/S values in Table 3. As is known to those familiar with textile dyeing processes, K/S values are color yield values based upon the Kubelka-Munk equation:

$$K/S = \frac{(1 - R/100)^2}{2R/100}$$

In a generally accepted method for determining dyeability, a reflectance measurement R is made of a dyed sample and the dyeability is expressed as the ratio of the absorption K to the scattering S, which is computed using the above formula. In the present case reflectance was measured using a Macbeth 1500+ Color Eye Instrument, Model M2020P2, manufactured by Macbeth, a division of Kollmorgen, P.O. Box 230, Newburgh, N.Y. 12550. The K/S values differ with dyeing technique, and these have been noted as A, B and C consistent with Table 4 and Table 3.

TABLE 4

| Dyeability Test Method | | |
|---|---|---|
| A | B | C |
| Pressure | Atmospheric | Atmospheric |
| 30:1 Liquor ratio | 50:1 Liquor | 50:1 Liquor ratio |
| *1 g/l DS-12 | No carrier | 8% Tanadel IM (Butyl Benzoate) |
| No carrier | 1 g/l DS-12 | 1 g/l DS-12 |
| Acetic Acid-pH (4.5-5.0) | Acetic Acid-pH (4.5-5.0) | Acetic Acid-pH (4.5-5.0) |
| 5% Disperse blue 27 | 5% Disperse blue 27 | 2% Disperse blue 27 |
| 3° F./min. rate | 3° F./min. rate | 3° F./min. rate |

TABLE 4-continued

| Dyeability Test Method | | |
|---|---|---|
| A | B | C |
| of rise | of rise | of rise |
| 30 mins. @ 265° F. | 30 mins. @ 210° F. | 60 mins. @ 210° F. |

*Leveling agent manufactured by Sybcon Chemicals, Inc., Wellford, South Carolina Comparison of the physical properties of any of the samples to the control illustrates the property advantages of the invention. For example, in Sample 3 of the 100% poly ring spun yarns, the skein break factor for the sample was 4881, while that of the control was 4659; the hot air shrinkage at 400° F. was only 8.5 percent, that of the control was likewise 8.5 percent; single end tenacity was 3.47 for the sample and 3.15 for the control; and for hoselegs formed from this yarn (50/50 ring spun), the dyeing capabilities of both the sample and the control were either identical or the sample was improved, depending upon the dyeability test method used. This represents about a 10 percent strength advantage for the yarn formed according to the invention relative to the control yarn with an equivalent dyeability and hot air shrinkage. The average strength advantage for all eight samples was similarly between approximately 3 and 13 percent, based on single end tenacity. The best comparisons, particularly dyeability, are made using the 100 percent polyester yarns because differences between the control and the samples become muted when the polyester fibers are blended with other fibers, particularly natural ones.

Samples 4 and 8 particularly demonstrate the enhanced dyeability of fibers modified according to the present invention which have also maintained an unexpectedly high tenacity. As seen in Table 3, Sample 4 exhibits a dyeability of 104.1 relative to the control while maintaining a tenacity higher than control in all cases. Sample 8 likewise exhibits a dyeability of 108.1 relative to the control while maintaining a tenacity higher than the control in each case where data is available.

This improvement in yarn strength achievable by the invention relative to standard polyester is expected to be a key factor in obtaining the highest possible rotor speeds in open-end spinning. Present developments indicate that rotor speeds of 100,000 rpm or greater will be available in the near future In other spinning techniques, such increased strength is similarly required. Ring spinning at present speeds of 20,000 rpm and up, jet spinning, and friction spinning all call for fibers having improved physical characteristics. The technology of the present invention is expected to provide good spinning efficiencies at such speeds while producing a product that remains dyeable with disperse dyes under atmospheric conditions, particularly when combined with selected low DPF fiber (e.g. 1.5 DPF or less). The advantages of the invention, however, are not limited to any particular size fiber.

Although the Applicants do not wish to be bound by any particular theory, it is recognized that many of a polymer's physical characteristics reflect the degree of crystallinity of a polymer. In the production of polymer filament, if all other factors are held substantially constant, the tensiles of the filament are lower when additives, such as polyethylene glycol are present. Copolymers particularly exhibit lower tensiles because the added comonomers interrupt the otherwise homogenous polymer and lower its crystallinity.

Alternatively, dyeability is enhanced by certain comonomers precisely because the homogeneity of the polymer is physically interrupted giving a dye molecule or a pigment a physical or chemical opportunity to attach to the polymer. Similarly, dyeability is discouraged when crystallinity is increased because of the lack of potential reaction sites and is therefore discouraged by higher temperature heat-setting and a higher percentage of the majority monomer.

Shrinkage is another variable which must be controlled in fiber and resulting fabrics. Shrinkage is increased by a lesser degree of crystallinity because the more amorphous regions, or the regions of comonomer or additive in the polymer chain tend to collapse under heat to a greater extent than do the more oriented or homogeneous portions of the polymer. Shrinkage is correspondingly decreased by a higher degree of crystallinity therefore, all other variables being equal, desirable low shrinkage properties tend to be competitive with desirable dyeability properties.

Another variable which is desirably controlled is the extent of orientation of the polymer. As known to those familiar with the nature of polymers, orientation refers to a somewhat ordered condition in which the long polymeric molecules are in a greater degree of linear relationship to one another, but are not in the lattice-site and bonding relationships with one another that would define a crystal lattice. All other factors remaining equal, increased orientation short of crystallization tends to result in increased shrinkage, as the application of heat tends to randomize the otherwise oriented molecules. This randomization tends to be reflected as a decrease in fiber length as the linearly oriented molecules move into less linear relationships with one another.

The invention therefore is a technique for adding sufficient polyethylene glycol to improve the dyeability of a polyester fiber, followed by physical treatment (drawing, heat setting) of the fiber in a manner that maintains sufficient crystallinity in spite of the added polyethylene glycol to keep the tensile properties (such as tenacity and modulus) and shrinkage substantially the same as comparative polyester homopolymer otherwise formed in the same manner.

As is further known to those familiar with such processes, the draw ratio under which the filament is initially formed is the variable other than the heat-setting temperature that controllably affects the orientation of the polymer; and therefore a number of the properties which relate to the orientation such as tensiles, dyeability, and shrinkage. As used herein, draw ratio is defined as the ratio of the final length at which the drawn filament is heat set, to the initial length of the filament prior to drawing. Other variables aside, a greater draw ratio increases the orientation of the polymer forming the filament, thereby increasing the tensiles and shrinkage of the resulting fiber, but decreasing the dyeability. A lower draw ratio decreases the tensiles and shrinkage of the fiber, and increases the dyeability. These relationships, however, hold true for polyester homopolymers as well as for copolymers such as the present invention, so that draw ratio can generally be selected to give desired tensiles within a given range defined by the nature of the polymer or copolymer. The contribution of the invention is the ability to increase the dyeability while maintaining the same tensile strength or to increase the tensile strength while maintaining the same dyeability. In other words, prior to the present invention the tensile strength and dyeability of polyester filament always moved in inverse relationship to one another. The present invention provides the capability of increasing one variable while substantially avoiding a disadvantageous decrease in the other variable, relative to an unenhanced fiber.

This result is demonstrated by the data summarized in Tables 5, 6 and 7. Table 5 shows data for draw ratio ("DR"), heat set temperature, skein break factor ("SBF"), hot air shrinkage ("HAS") and dyeability for a regular polyester fiber, a fiber formed using 5 percent by weight diethylene glycol ("DEG"), and fibers formed using 3 percent and 2.75 percent by weight of polyethylene glycol having average molecular weights of 400 and 600 g/mole respectively. All of these were heat set at temperatures otherwise similar to those of the present invention. Tables 6 and 7 summarize the relationships between these parameters and resulting characteristics. In each of the four examples of Table 5, draw ratio and heat set temperature were alternatively selectively adjusted, and the resulting effects on the skein break factor, hot air shrinkage, and dyeability were observed and tabulated. Table 5 also shows that a satisfactory intrinsic viscosity can be maintained using the invention.

When the relationships between these variables are evaluated mathematically they can be expressed as the linear relationships set forth in Table 6. The generally high correlation factors of Table 6 demonstrate the accuracy of the mathematical models; i.e. linear algebraic equations with which the effects of the invention may be observed.

Using the equations developed, the comparisons of Table 7 can be formulated and clearly demonstrate the advantages of the invention.

Example 1 of Table 7 shows the difference in hot air shrinkage for the control and 5% DEG fibers when the draw ratios and heat set temperatures are selected to maintain the skein break factor and dyeability otherwise equal to one another. As shown by the resulting hot air shrinkage, the inclusion of 5% DEG increases the shrinkage from about 10% to about 15% with these other factors being held constant. Five percent represents the total DEG present; a smaller amount of DEG, usually about 2 percent, is generally present as a byproduct of the synthesis of the polyester.

In Example 2, the parameters have been selected to compare the effect of the added DEG on the dyeability while maintaining skein break factor and hot air shrinkage equivalent to one another. As seen therein, the dyeability of the sample decreases somewhat relative to the control, illustrating the fundamental trade-off between dyeability and strength required by the prior techniques.

In Example 3, the skein break factor and hot air shrinkage for the control fiber and a fiber containing 3 percent polyethylene glycol having an average molecular weight of about 400 g/mole formed according to the present invention have been compared at equivalent dyeability. As set forth in the Table 7, both the hot air shrinkage and the skein break factor for the fiber formed according to the present invention show a marked improvement over the control.

In Example 4, these same two characteristics have likewise been compared to the control fiber at equivalent dyeability, but with the fiber formed according to the invention incorporating 2.75 percent by weight of polyethylene glycol having an average molecular weight of 600 g/mole. Again, both of these physical characteristics show marked improvement compared to the control.

TABLE 5

| OBS | DR | TEMP | SBF | HAS | DYE§ |
|---|---|---|---|---|---|
| | | CONTROL (IV = 0.55) | | | |
| 1 | 2.85 | 150.5 | 3653 | 8.2 | 91.9 |
| 2 | 3.25 | 150.5 | 4335 | 10.2 | 81.4 |
| 3 | 2.85 | 178.3 | 3579 | 6.2 | 86.6 |
| 4 | 3.25 | 178.3 | 4216 | 9.2 | 74.1 |
| | | 5 PERCENT DEG (IV = 0.54) | | | |
| 1 | 3.3 | 200.9 | 3829 | 5.3 | 73.0 |
| 2 | 2.9 | 200.9 | M | M | 90.6 |
| 3 | 2.9 | 150.5 | 3275 | 8.8 | 99.2 |
| 4 | 3.3 | 150.5 | 3858 | 11.2 | 86.3 |
| | | 3.0 PERCENT 400 MOLE WT. PEG (IV = 0.55) | | | |
| 1 | 2.90 | 181.0 | 3577 | 6.0 | 108.2 |
| 2 | 3.30 | 181.0 | 4148 | 7.2 | 90.8 |
| 3 | 2.90 | 200.9 | 3515 | 3.8 | 105.9 |
| 4 | 3.30 | 200.9 | 4139 | 4.9 | 87.2 |
| | | 2.75 PERCENT 600 MOLE WT. PEG (IV = 0.57) | | | |
| 1 | 3.5 | 181.0 | 3704 | 7.0 | 87.6 |
| 2 | 3.9 | 181.0 | 4771 | 8.8 | 90.8 |
| 3 | 3.5 | 200.9 | 4202 | 5.5 | 89.3 |
| 4 | 3.9 | 200.9 | 4695 | 7.1 | 85.0 |

§-All dyeabilities were determined using Method C of Table 4
DR = Draw Ratio
TEMP = Heat Setting Temp
SBF = Skein Break Factor
HAS — Hot Air Shrinkage

TABLE 6

| | Correlation Factor ($R^2$) |
|---|---|
| CONTROL | |
| SBF = 1648.8 × DR − 1083 | 98 |
| HAS = 6.25 × DR − 0.056 × TEMP − 1.47 | 97 |
| DYE = −28.75 × DR − 0.227 × TEMP + 208.4 | 99 |
| 5% DEG | |
| SBF = 1421.3 × DR − 846.6 | 99 |
| HAS = 6.00 × DR − 0.117 × TEMP + 9.02 | 99 |
| DYE = −38.12 × DR − 0.217 × TEMP + 243.6 | 98 |
| 3.0% 400 MW PEG | |
| SBF = 1493.8 × DR − 785.9 | 99 |
| HAS = 2.92 × DR − 0.113 × TEMP + 17.92 | 99 |
| DYE = −45.13 × DR − 0.148 × TEMP + 266.1 | 98 |
| 2.75% 600 MW PEG | |
| SBF = 1950.0 × DR − 2872.0 | 83 |
| HAS = 4.25 × DR − 0.080 × TEMP + 6.65 | 99 |
| DYE = −39.00 × DR + 231.7 | 98 |

TABLE 7

| | INDEPENDENT | | DEPENDENT | | |
|---|---|---|---|---|---|
| | DR | HEAT SET TEMP | SBF | HAS | DYE |
| | Example One | | | | |
| CONTROL | 2.84 | 118.2 | 3600 | 9.7 | 100 |
| 5% DEG | 3.13 | 112.0 | 3600 | 14.7 | 100 |
| | Example Two | | | | |
| CONTROL | 2.84 | 160.7 | 3600 | 7.3 | 90 |
| 5% DEG | 3.13 | 173.4 | 3600 | 7.5 | 87 |
| | Example Three | | | | |
| CONTROL | 2.84 | 118.2 | 3600 | 9.7 | 100 |
| 3.0% 400 MW PEG | 3.07 | 185.0 | 3800 | 6.0 | 100 |
| | Example Four | | | | |
| CONTROL | 2.84 | 118.2 | 3600 | 9.7 | 100 |

TABLE 7-continued

| | INDEPENDENT | | DEPENDENT | | |
|---|---|---|---|---|---|
| | DR | HEAT SET TEMP | SBF | HAS | DYE |
| 2.75% 600 MW PEG | 3.38 | 185.0 | 3720 | 6.2 | 100 |

The FIGURE of the drawing shows another relationship, that between lightfastness of the copolymer, the average molecular weight of the added PEG in the copolymer, and the percent by weight of PEG in the copolymer for fabrics dyed using the same dye formulations. The drawing is compiled from five data points; no added PEG; and 5 percent by weight PEG of average molecular weight of 400, 600, 1000 and 1450 grams per mole respectively. The resulting lines are thus interpolations between these points. The lightfastness is measured using AATCC (American Association of Textile Chemists and Colorists) test 16E-1982 for 40 hours, and the associated standards in which 5 represents the best lightfastness. The data shows that lightfastness and the best balance of physical properties is best using the 400 average molecular weight PEG of the preferred embodiment, and is likewise higher at the 2 percent amount of the preferred embodiment.

Finally, the invention offers one more advantage; polyester spinning through-put can be increased by as much as about 5 percent. This result is likewise obtained because the inclusion of polyethylene glycol in the copolymer suppresses the orientation of the copolymer relative to a homopolymer of polyester under the same spinning conditions. Because less oriented fibers need to be drawn at a higher draw ratio to get an equivalent tensile strength at an equivalent denier, a greater through-put in spinning is required. This "requirement", however, is an advantageous one, because it results in a greater through-put in terms of pounds produced per hour without any additional equipment capacity.

The through-put advantages of the invention can be demonstrated by observing the natural draw ratio ("NDR") of fibers formed according to the present invention compared to the NDR of control fibers produced conventionally. The natural draw ratio for a fiber is the draw ratio at which the fiber will no longer "neck". Alternatively, this can be expressed as the amount of draw required to end necking and begin strain hardening of a drawn fiber. As is known to those familiar with filament processes, when a filament is first drawn, it forms one or more drawn and undrawn portions in which the drawn portions are referred to as the "neck". At the natural draw ratio, however, the neck and undrawn portions disappear and the filament obtains a uniform cross section which then decreases uniformly (rather than in necks and undrawn portions) as the fiber is drawn further.

The natural draw ratio reflects the degree of orientation of the polymer in the fiber, with a lower natural draw ratio reflecting a higher degree of orientation, and vice versa. In a fiber formed according to the present invention using approximately 2 percent polyethylene glycol having an average molecular weight of about 400 grams per mole, the natural draw ratio is shown to increase 5 percent, thus orientation is shown to decrease.

In the drawings and specification, there have been disclosed typical preferred embodiments of the invention and, although specific terms have been employed, they have been used in a generic and descriptive sense only and not for purposes of limitation, the scope of the invention being set forth in the following claims.

That which is claimed is:

1. An enhanced polyester fiber which has a superior combination of tensile, dyeability and shrinkage properties, said fiber consisting essentially of a copolymer of polyester and polyethylene glycol, in which said polyethylene glycol has an average molecular weight of between about 200 and about 1500 grams per mol, and in which said polyethylene glycol is present in an amount of between about 1.0 and 4% by weight based on the weight of the copolymer, and said fiber having a tensile strength greater than 5.2 grams per denier, after being fully drawn and crimped.

2. An enhanced polyester fiber according to claim 1 having a melting point no lower than about 254 degrees centigrade.

3. An enhanced polyester fiber according to claim 1 wherein said polyethylene glycol has an average molecular weight of between about 200 and 600 grams per mole.

4. An enhanced polyester fiber according to claim 1 wherein said polyethylene glycol has an average molecular weight of about 400 grams per mole.

5. An enhanced polyester fiber according to claim 1 wherein said polyethylene glycol is present in an amount of about 2 percent by weight based on the weight of the copolymer.

6. An enhanced polyester fiber according to claim 1 having a hot air shrinkage of about 8 percent or less.

7. An enhanced polyester fiber according to claim 1 having a modulus of between about 3.4 and 4.3 grams per denier.

8. An enhanced polyester fiber according to claim 1 having the following characteristics:

a tensile strength of between about 5.2 and 6.2 grams per denier; and a hot air shrinkage of less than 8 percent.

9. An enhanced polyester fiber according to claim 1 having a dyeability K/S ratio of between about 18.00 and 20.00 when pressure dyed without a dye carrier.

10. An enhanced polyester fiber according to claim 1 having a dyeability K/S ratio of between about 5.30 and 6.40 when dyed under atmospheric conditions in the absence of a dye carrier.

11. An enhanced polyester fiber according to claim 1 having a dyeability K/S ratio of between about 6.9 and 7.9 when dyed under atmospheric conditions using a dye carrier.

12. An enhanced polyester fiber according to claim 1 having a lightfastness greater than about 3.5 based upon AATCC Test Method 16E-1982 for 40 hours.

13. An enhanced polyester fiber according to claim 1 which comprises a continuous filament.

14. An enhanced polyester fiber according to claim 1 which comprises a staple fiber.

15. A filament yarn formed from the enhanced polyester fiber according to claim 1.

16. A ring spun yarn formed from staple fibers according to claim 15.

17. A ring spun yarn according to claim 16 further comprising cotton staple fibers.

18. An open-end spun yarn formed from staple fibers according to claim 15.

19. An open-end spun yarn according to claim 18 further comprising cotton staple fibers.

20. A fabric formed from yarns comprising the enhanced polyester fiber of claim 1.

21. A fully drawn, crimped and dried tow comprising filaments formed from a copolymer consisting essentially of polyester and about 2 percent by weight polyethylene glycol in which said polyethylene glycol has an average molecular weight of about 400 grams per mole, said tow having a tenacity of at least 5.25 grams per denier.

22. A tow according to claim 10 having a tensile strength of at least 6.00 grams per denier.

* * * * *